United States Patent [19]

Sigworth

[11] Patent Number: 5,041,263

[45] **Date of Patent: * Aug. 20, 1991**

[54] THIRD ELEMENT ADDITIONS TO ALUMINUM-TITANIUM MASTER ALLOYS

[75] Inventor: Geoffrey K. Sigworth, Reading, Pa.

[73] Assignee: KB Alloys, Inc., Sinking Spring, Pa.

[ * ] Notice: The portion of the term of this patent subsequent to Mar. 14, 2006 has been disclaimed.

[21] Appl. No.: 300,903

[22] Filed: Jan. 24, 1989

Related U.S. Application Data

[63] Continuation of Ser. No. 904,511, Sep. 8, 1986, Pat. No. 4,812,290.

[51] Int. Cl.[5] ..... C22C 21/00

[52] U.S. Cl. ..... 420/552

[58] Field of Search ..... 420/552

[56] References Cited

U.S. PATENT DOCUMENTS

| | | | |
|---|---|---|---|
| 4,298,408 | 11/1981 | Langdon et al. . | |
| 4,748,001 | 5/1988 | Banerji et al. | 420/552 |
| 4,812,290 | 3/1989 | Sigworth | 420/552 |

FOREIGN PATENT DOCUMENTS

| | | |
|---|---|---|
| 66601/86 | 12/1986 | Australia . |
| 3527434A1 | 2/1986 | Fed. Rep. of Germany . |
| 2266746 | 10/1975 | France . |
| 48-84013 | 11/1973 | Japan . |
| 49-17133 | 4/1974 | Japan . |
| 56-102544 | 8/1981 | Japan . |
| 62-133037 | 6/1987 | Japan . |
| 2171723 | 3/1986 | United Kingdom . |

OTHER PUBLICATIONS

Banerji and Reif, "Grain Refinement of Aluminum as Related to the Morphology of $Al_3Ti$ Primary Phase in Al-Ti-B Master Alloys," *Metall.* (39 Jahrgang, Heft 6, Juni 1985), pp. 513-519.

*Metals Handbook*, 8th Ed., vol. 8, "Metalography Structures and Phase Diagrams," pp. 264, 344 (1973).

Davies, et al., "The Nucleation of Aluminum Grains in Alloys of Aluminum with Titanium and Boron," *Metallurigical Transactions*, vol. 1, pp. 275-280 (Jan. 1970).

*Primary Examiner*—Melvyn J. Andrews

*Attorney, Agent, or Firm*—Dickstein, Shapiro & Morin

[57] ABSTRACT

Provided is an improved aluminum-titanium master alloy containing carbon in a small but effective content and not more than about 0.1%. After melting, the master alloy is superheated to about 1200°-1250° C. to put the carbon into solution, then the alloy is cast in a workable form. The master alloy in final form is substantially free of carbides greater than about 5 microns in diameter. The alloy of this invention is used to refine aluminum products that may be rolled into thin sheet, foil, or fine wire and the like.

3 Claims, No Drawings

THIRD ELEMENT ADDITIONS TO ALUMINUM-TITANIUM MASTER ALLOYS

This application is a continuation of application Ser. No. 904,511, filed Sept. 8, 1986, now U.S. Pat. No. 4,812,290.

This invention relates to aluminum-titanium master alloys which are used for the grain refining of aluminum. More particularly, the invention relates to the addition of carbon and other third elements to the master alloy to improve its ability to grain refine.

PRIOR ART AND BACKGROUND

A very limited amount of experimental work is reported in the prior art. A. Cibula (in an article entitled "The Mechanism of Grain Refinement of Sand Castings in Aluminium Alloys," written in the *Journal of Institute of Metals*, vol. 76, 1949, pp. 321-360) indicates that carbon in the master alloy does in fact influence grain refining. In the 1951-52 *Journal of Institute of Metals*, vol. 80, pp. 1-16, Cibula reported further work in the article, "The Grain Refinement of Aluminium Alloy Castings by Additions of Titanium and Boron". As indicated in the title, the effect of adding B and C to Al-Ti master alloys was studied. The results of this work on the effect of carbon is quoted directly from his paper:

"Although the results obtained above with titanium carbide additions confirmed that it is possible to produce grain refinement with much smaller titanium additions than are normally used, no method of practical value was found. (Emphasis added.) The results showed that the obstacles in increasing the carbon content of aluminium [sic] titanium alloys are largely caused by the difficulty of achieving intimate contact and wetting between carbon or titanium carbide and molten aluminium, either due to interference by oxide films or to inherently unsuitable angles of wetting. It has been suggested that one way of avoiding the difficulty would be by pre-wetting titanium carbide powder by sintering with nickel or cobalt powder, but the high melting point of these metals would be inconvenient with aluminium alloys and bridging between carbide particles might prevent their complete dispersion."

"The introduction of carbon into molten aluminium-titanium alloys is also limited by the low solubility of carbon in the melt, for any excess of carbide would tend to remain where it was formed, in contact with the source of carbon, instead of dispersing in the melt, unless the carbide could be precipitated in the liquid metal."

"In the work described in the next section on the use of titanium boride instead of titanium carbide, the difficulties described above were overcome by using separate aluminium-titanium and aluminium-boron hardener alloys: by this means it was possible to precipitate the boride particles in the melt and control the excess of either constituent. This could not be done with titanium carbide additions because carbon cannot be alloyed with aluminium."

F. A. Crossley and L. F. Mondolfo wrote in the *Journal of Metals*, 1951, vol. 3, pp. 1143-1148. In this report they found that the addition of $Al_4C_3$, or graphite, to aluminum titanium melts resulted in a decrease in grain refining effect.

Further experiments in the art were recorded in 1968 by E. L. Glasson and E. F. Emley in an article in the book entitled "Solidification of Metals" (ISI publication No. 110, 1968) pp. 1-9. In this article, Glasson and Emley reported that $C_2Cl_6$, or graphite, may be incorporated into salt tablets to improve grain refining by forming titanium carbide.

Further experiments in this area of research were reported by Y. Nakao, T. Kobayashi and A. Okumura in the *Japanese Journal of Light Metals*, 1970, vol. 20, p. 163. Nakao and co-workers achieved essentially similar results by incorporating titanium carbide powder in a salt flux.

More recent experiments were reported in an article in the *Journal of Crystal Growth*, 1972, vol. 13, p. 777 by J. Cisse, G. F. Bolling, and H. W. Kerr. In this paper, the nucleation of aluminum grains was observed on massive titanium carbide crystals, and it was established that this epitaxial orientation relationship exists.

$$(001)_{Al} \| (011)_{TiC}; [001]_{Al} \| [001]_{TiC}$$

More recently, A. Banerji and W. Reif briefly described an Al-6%Ti-1.2%C master alloy in *Metallurgical Transactions*, vol. 16A, 1985, pp. 2065-2068. This alloy was observed to grain refine 7075 alloy, and a patent application (No. 8505904 dated 3/1/85) was filed in the U.K.

A review of the prior art indicates that the problem has not been solved. Although there are indications that carbon may be beneficial in the grain refining of aluminum, massive carbides are found within the final product. This difficulty is summarized most succinctly in the second and third paragraphs of the above quotation from Cibula's 1951 study, and explains why boron, not carbon, has found commercial application as a third element in Al-Ti master alloys. Large, hard, insoluble particles cannot be present in master alloys used to refine alloys used in the manufacture of thin sheets, foil, or can stock. Large particles in thin products cause pinholes and tears.

This is essentially the crux of the problem: massive hard particles have prevented the development of an effective aluminum master alloy containing carbon This invention has solved the problem.

OBJECTS OF THIS INVENTION

It is an object of this invention to provide a grain refiner for aluminum that may be produced into critical final products such as thin sheet and foil. Another object is to provide a master alloy that contains carbon, or other third elements, and thereby acts as an effective refiner. Still another object is a process of producing a grain refiner in which the carbon, or other third element, is in solution in the matrix, rather than being present as massive hard particles.

SUMMARY OF THE INVENTION

These and other objects are obtained by providing an aluminum master alloy containing titanium and a third improving element in a small but effective amount (up to 0.1% for carbon), wherein the improving element is placed in solution in the matrix during a high temperature solution step, so that the product is substantially free of second-phase particles greater than about 5 microns in diameter. The master alloy is preferably melted in a crucible chamber, including thermocouple protection tubes and the like, substantially free of carbides, nitrides, etc. For example, aluminum oxide, beryllium oxide, and magnesium oxide are well-suited for this purpose. After melting and making the alloy at a relatively low temperature, the alloy is superheated to over 1150° C. (about 1200° C. to 1250° C.) for at least about 5 minutes in an inert crucible for the solutioning processing step. The alloy may then be cast and finally prepared in forms normally marketed in the art: i.e., waffle, cast rod, extruded or rolled rod and the like.

Although carbon is preferred, the third effective element in solution may be sulfur, phosphorus, boron, nitrogen, and the like to provide the benefits of this invention. For best results, the third element is present in controlled amounts: within the range 0.003 to 0.1% for carbon, 0.01 to 0.4% for boron, and 0.03 to 2% for the other elements.

EXAMPLES OF THE INVENTION

Five examples of this invention, and one example of the prior art, are given below to illustrate the scope of this discovery. Each example was produced in a small laboratory furnace by melting aluminum and reacting with reagents. All alloys have essentially the same nominal titanium composition, 5 percent by weight.

1. An Example of the Prior Art

An Al-5%Ti alloy was made by reacting 3 kg of 99.9%Al and 860 grams of $K_2TiF_6$. The aluminum was melted and brought to 760° C. A stirring paddle was immersed in the melt and allowed to rotate at 200 revolutions per minute. The potassium fluoborate salt was fed to the surface of the melt and allowed to react for 15 minutes. At the end the salt was decanted and the material poured into waffle form. The grain refining ability of this alloy is shown below in Table I: grain sizes of about 1000 microns are found at short contact times.

2. Al-Ti-S Master Alloy

An Al-Ti-S alloy was prepared by melting 3 kg of aluminum and bringing it to a temperature of 760° C. A mixture of 860 grams of $K_2TiF_6$ and 50 grams of ZnS was fed to the surface of the melt and allowed to react. The spent salt was decanted and the material cast off into waffle. The waffle was remelted in an induction furnace lined with an alumina crucible, heated to 1250° C., and cast into waffle. The grain sizes obtained with this master alloy are also shown in Example 2 of Table I. As one can see, the presence of sulfur markedly increases the ability of the alloy to grain refine. Grain sizes as low as 250 microns were obtained with this master alloy.

3. An Al-Ti-N Master Alloy

A mixture of 860 grams of $K_2TiF_6$ and 50 grams of TiN were fed to 3 kg of molten aluminum held at a temperature of 760° C. The salt was allowed to react and then decanted from the surface of the melt, whereupon the alloy was cast into waffle. The resulting Al-Ti-N alloy was placed in an induction furnace, which was lined with an aluminum oxide crucible and heated to 1250° C. and cast into waffle. The resulting ingot gave the grain size response shown in Example 3 of Table I. Although not as effective as sulfur, nitrogen does improve the performance of the alloy, giving grain sizes of approximately 450–600 microns at short times.

4. Al-Ti-P Master Alloy

Three (3) kg of 99.9%Al was melted and 50 grams of a Cu-6%P alloy was added to the melt. Subsequently, 860 grams of $K_2TiF_6$ was fed to the surface of the melt, with stirring, and the salt was allowed to react with the aluminum. The salt was decanted and the alloy poured from the furnace. It was subsequently remelted in an induction furnace lined with an aluminum oxide crucible and cast from 1250° C. The waffle made in this fashion gave the grain sizes shown in Table I. It can be seen that the alloy is roughly equivalent to that produced with nitrogen, and much better than prior art Al-Ti alloy which does not contain the third element addition.

5. Al-Ti-C Master Alloy

A charge of 9,080 grams of aluminum was melted in an induction furnace and brought to 750°–760° C., whereupon a mixture of 200 grams of $K_2TiF_6$ and 25 grams of $Fe_3C$ was fed to the surface of the melt and allowed to react. Subsequently, 730 grams of Ti sponge was added to the melt and allowed to react. The maximum temperature obtained during the reaction was 970° C. The salt was decanted, the heat transferred to a furnace containing an oxide crucible, and the carbon placed in solution by bringing the alloy to a temperature of 1250° C. The grain refining ability of this alloy is shown in Example 5 of Table I. Extremely fine grain sizes are obtained at the 0.01%Ti addition level: grain sizes of 300 microns or less were obtained at contact times of ½ to 10 minutes.

6. Al-Ti-C Alloy

This alloy was made in exactly the same fashion as Example 5 above, only carbon was added with the $K_2TiF_6$ as 2½ grams of carbon black, instead of using iron carbide. The maximum temperature obtained, after the Ti sponge addition, was 890° C. Waffle cast from 1250° C. gave the grain refining performance shown in Example 6 of Table I. Extremely fine grain sizes were found at contact times of ½ to 10 minutes.

DISCUSSION OF RESULTS

It is clear from the results of these examples, as well as from the results of other heats produced in the course of experimentation for this invention, that the controlled addition of third elements can have a marked beneficial effect on the grain refining ability of Al-Ti master alloys. The method of addition of the third element does not appear to be important to the alloy, nor is the method of addition of titanium important. For example, carbon has been placed into the master alloy by the introduction of powdered graphite, carbon black, and metal carbides. All work equally well. It is important only to introduce a small but controlled amount of the third element, in order to obtain the best results. This is usually done at low temperatures because the recovery of Ti and the third elements is usually more predictable at the low temperature, and because the reaction proceeds very smoothly. The reaction temperature is not critical, however. No change in the range of 700°–900° C. was observed. The third element is then placed into solution by bringing the melt, which is now held in an inert crucible, to extremely high temperature. The alloy is cast from the high temperature, and a superior grain refiner is produced.

Although specific embodiments of the present invention have been described in connection with the above illustrative examples, it should be understood that various other modifications can be made by those having ordinary skills in the metallurgical arts without departing from the spirit of the invention taught herein. Therefore, the scope of this invention should be measured solely by the appended claims.

TABLE I

GRAIN REFINING RESPONSE OF Al—Ti AND Al—Ti THIRD ELEMENT MASTER ALLOYS (0.01% Ti added to 99.7% Al held at 730° C.)

| Example No. | Alloy Type | Waffle Cast in Heat No. | Grain Size* at Various Contact Times** (min.) 0 | ½ | 1 | 2 | 5 | 10 | 25 | 50 | 100 |
|---|---|---|---|---|---|---|---|---|---|---|---|
| 1 | Al—Ti | 541-44 | >2000 | 1000 | 921 | 1093 | 1060 | 1060 | 1400 | — | — |
| 2 | Al—Ti—S | 563-13B | >2000 | 460 | 333 | 251 | 275 | 388 | 538 | 921 | 853 |
| 3 | Al—Ti—N | 563-13A | >2000 | 564 | 500 | 530 | 460 | 583 | 686 | 833 | 1129 |
| 4 | Al—Ti—P | 563-13C | >2000 | 648 | 603 | 583 | 492 | 416 | 744 | 1296 | 1750 |
| 5 | Al—Ti—C | 563-15A | >2000 | 313 | 282 | 336 | 257 | 321 | 593 | 564 | 564 |
| 6 | Al—Ti—C | 563-15B | >2000 | 243 | 246 | 238 | 286 | 296 | 479 | 714 | 660 |

*Grain size is the average intercept distance, in microns, as measured according to ASTM Procedure E112.
**The "contact time" is the time elapsed since the master alloy addition to the melt; or the time the master alloy is in "contact" with the melt.

What is claimed is:

1. An Al-Ti master alloy consisting essentially of, in weight percent, carbon up to 0.1, titanium 2 to 15, and the balance aluminum plus impurities normally found in master alloys wherein the alloy is substantially free of carbides greater than about 5 microns in diameter.

2. The master alloy of claim 1 wherein the weight percent of carbon is greater than about 0.003 but less than 0.1.

3. The master alloy of claim 1 wherein the weight percent of carbon is from about 0.018 to about 0.028.

* * * * *